US010731923B2

(12) United States Patent
Cobos

(10) Patent No.: US 10,731,923 B2
(45) Date of Patent: Aug. 4, 2020

(54) FURNACE FOR MELTING AND TREATING METAL AND METALLIC WASTE AND METHOD THEREFOR

(71) Applicant: DIGIMET 2013 SL, Guipúzcoa (ES)

(72) Inventor: Luis Cobos, Guipúzcoa (ES)

(73) Assignee: DIGIMET 2013 SL, Guipúzcoa (ES)

( * ) Notice: Subject to any disclaimer, the term of this patent is extended or adjusted under 35 U.S.C. 154(b) by 402 days.

(21) Appl. No.: 15/567,964

(22) PCT Filed: Apr. 7, 2016

(86) PCT No.: PCT/EP2016/057671
§ 371 (c)(1),
(2) Date: Oct. 19, 2017

(87) PCT Pub. No.: WO2016/169780
PCT Pub. Date: Oct. 27, 2016

(65) Prior Publication Data

US 2018/0156540 A1 Jun. 7, 2018

(30) Foreign Application Priority Data

Apr. 23, 2015 (EP) ..... 15382205

(51) Int. Cl.
*F27D 27/00* (2010.01)
*F27B 3/10* (2006.01)
(Continued)

(52) U.S. Cl.
CPC ..... *F27D 27/00* (2013.01); *F27B 3/10* (2013.01); *F27D 11/08* (2013.01); *F27D 27/005* (2013.01);
(Continued)

(58) Field of Classification Search
CPC ..... F27D 27/00; F27D 27/005; F27D 11/08; F27D 2003/0054; F27D 2003/0083
(Continued)

(56) References Cited

U.S. PATENT DOCUMENTS 3,196,795 A * 7/1965 Baker ..... H02K 44/06 373/85
3,251,302 A * 5/1966 Baker ..... H02K 44/06 417/50
(Continued)

FOREIGN PATENT DOCUMENTS

CN 201335610 Y 10/2009
CN 102213552 A 10/2011
(Continued)

OTHER PUBLICATIONS

International Search Report dated Jun. 14, 2016 re: Application No. PCT/EP2016/057671; pp. 1-4; citing: U.S. Pat. No. 2011/248432 A1, EP 1 674 814 A2, CN 201 335 610 Y, EP 2 765 381 A1, EP 2 708 839 A1, FR 2 623 210 A1 and SU 1 152 095 A1.
(Continued)

*Primary Examiner* — Hung D Nguyen
(74) *Attorney, Agent, or Firm* — Cantor Colburn LLP

(57) ABSTRACT

A furnace includes a tank having outer and inner walls defining a closed canal to be filled with molten metal continuously circulating along the canal. The canal includes at least one heating area having a heating component for transferring energy to the molten metal thus overheating it; at least one loading area for loading metal or metallic waste into the molten metal; a melting/treatment area for receiving the overheated molten metal and material dragged on its surface. The overheated molten metal transfers its exceeding energy to the material, causing its melting/treatment. The furnace has a central hollow delimited by the inner wall and a driving component within the hollow, having a rotor with
(Continued)

at least one magnet body and coupled to a motor and configured to rotate upon activation of the motor, generating a magnetic field capable of causing circulation of the molten metal in a continuous and cyclical manner.

16 Claims, 10 Drawing Sheets

(51) Int. Cl.
*F27D 11/08* (2006.01)
*F27D 3/00* (2006.01)

(52) U.S. Cl.
CPC ..... *F27D 2003/0054* (2013.01); *F27D 2003/0083* (2013.01)

(58) Field of Classification Search
USPC ..... 373/85, 116, 146; 75/10.16, 10.67, 583, 75/708; 266/94, 99, 233, 234, 235, 237; 65/135.2, 135.3; 164/441, 443, 444, 447, 164/468, 504, 514, 515; 110/258
See application file for complete search history.

(56) References Cited

U.S. PATENT DOCUMENTS

| | | | | |
|---|---|---|---|---|
| 4,060,408 | A | 11/1977 | Kuhn | |
| 4,322,245 | A | 3/1982 | Claxton | |
| 8,158,055 | B2 | 4/2012 | Takahashi | |
| 8,585,962 | B2 | 11/2013 | Takahashi | |
| 2006/0133194 | A1* | 6/2006 | Takahashi | B01F 5/102 366/147 |
| 2006/0180963 | A1 | 8/2006 | Thut | |
| 2011/0074072 | A1 | 3/2011 | Rauch | |
| 2011/0248432 | A1 | 10/2011 | Takahashi | |
| 2013/0249149 | A1 | 9/2013 | Morando | |
| 2014/0252698 | A1* | 9/2014 | Rauch | F27D 21/00 266/99 |
| 2016/0052053 | A1* | 2/2016 | Wagstaff | B22D 35/00 |

FOREIGN PATENT DOCUMENTS

| | | | |
|---|---|---|---|
| EP | 0384987 | A1 | 9/1990 |
| EP | 1674814 | A2 | 6/2006 |
| EP | 2009121 | A1 | 12/2008 |
| EP | 2708839 | A1 | 3/2014 |
| EP | 2765381 | A1 | 8/2014 |
| FR | 2623210 | A1 | 5/1989 |
| GB | 2269889 | A | 2/1994 |
| JP | H10146640 | A | 6/1998 |
| JP | 2011012950 | A | 1/2011 |
| KR | 20140049978 | A | 4/2014 |
| RU | 2233344 | C1 | 7/2004 |
| RU | 2443961 | C2 | 2/2012 |
| SU | 1152095 | A1 | 4/1985 |
| WO | 2011074072 | A1 | 6/2011 |
| WO | 2012117355 | A1 | 9/2012 |
| WO | 2014202966 | A1 | 12/2014 |

OTHER PUBLICATIONS

Written Opinion dated Jun. 14, 2016 re: Application No. PCT/EP2016/057671; pp. 1-8; citing: U.S. Pat. No. 20111248432 A1, EP 1 6174 814 A2 and CN 201 335 610 Y.

* cited by examiner

FURNACE FOR MELTING AND TREATING METAL AND METALLIC WASTE AND METHOD THEREFOR

TECHNICAL FIELD

The present disclosure relates to the field of furnaces for melting and/or treating metals and/or metallic wastes. In particular, it relates to furnaces for circulation of a molten metal bed.

BACKGROUND

A wide variety of furnaces whose geometry, procedure and heating systems differ significantly are used in melting and treating metals and metallic waste. Depending on their mode of operation, the furnaces can be grouped into continuous or batch furnaces, which can use electricity or fossil fuels. They may also be classified according to their geometry. They can be of direct or indirect application. The advantages of each type of furnace are directly related to the type and size of the load used, since it largely determines the energetic efficiency and metallurgical quality resulting from the melting or treatment processes.

Moreover, one aspect common to all melting or treatment processes is the formation of floating slag. The way and condition in which the slag is separated from the molten or treated metal is a particular and distinctive feature of each furnace, as it represents an important restriction with respect to the operating system used. Therefore, whilst in the cupola furnace slag is automatically extracted continuously and in a liquid state, in an induction furnace it must be removed in a semi-solid state by manual and batch operation after each melting or treatment and before emptying the furnace. In rotary furnaces, this is done after the full tapping of the metal, by tipping or turning the furnace prior to proceeding with the new load.

In any case, the industrial reality presents a variety of furnaces with significant differences in performance and operability. The systems mostly used are based on direct heating of the load by means of induction currents, radiation or convection. The cupola furnace is an example of continuous direct heating and melting producing an excellent metallurgical quality, but it has the disadvantage of being a highly polluting facility as it uses coke as an energy source. Furthermore we must consider the quality and dimensional constraints imposed on the load in order to provide it with sufficient permeability and composition to allow the flow of ascending gases and the appropriate degree of recarburation. The electric furnace is not subject to these constraints, as it can take any type of load, with its size being the only limitation imposed by the diameter of the furnace. For example, European Patent EP0384987B1 describes an electric furnace. However, electric furnaces have the disadvantage of having to cool the coil, which represents a significant reduction in its energy efficiency and a high maintenance cost due to the high power factor to be contracted. Gas furnaces, despite using a less burdensome energy source, have even lower energy efficiency and cause higher losses through the oxidation of the load material due to convection heating.

The U.S. Pat. Nos. 4,060,408 and 4,322,245 describe reverberatory furnaces in which the metal bath surface is separated into different chambers. The metal is circulated using rotary pumps that propel it through passages and ducts made in the walls separating the different chambers. In both cases, the heating is direct and gas burners are applied both in the loading and the maintenance chamber, which leads to the inevitable oxidation of part of the metal and results in poor energy efficiency. The US patent application US2013/0249149A1 tries to solve this problem by mounting a radiant plate separating the load from the burner. Metal heating is produced by radiation of the plate on the metal bath protected by a nitrogen atmosphere to prevent loss caused by oxidation. However, the above three proposals are limited by the same aspect, that is the variable level of the height of the bath, which prevents the continuous removal of the generated slag. This imposes the performing of manual and repetitive cleaning, which interferes in the working of the furnace. For example, the de-slagging gates must be opened in the middle of the melting process.

Moreover, the mechanical arrangement of rotors immersed in the metal for its recirculation limits the use of these furnaces to non-ferrous metals of low melting point, not being suitable for processing iron or steel, whose melting point occurs at temperatures that the rotors submerged in the metal do not tolerate. For example, U.S. Pat. No. 8,158,055B2 describes a magnetic rotor coupled to an outer channel connecting two ends of a vessel and which generates a metal stream that extracts and reintroduces a small portion of molten metal into the heating chamber. This magnetic rotor cannot be used for recirculating all the molten metal, but is used to homogenize the bath temperature and chemical composition.

European patent application EP2009121A1 describes a waste treatment method in which a molten metal bed continuously moves and defines a closed circuit. The waste is retained on the surface of the molten metal bed. The waste is treated under the effect of the constant and continuous heat exchange generated by the movement of the molten metal bed beneath the waste retained thereon.

In sum, currently there are no furnaces of discretionary use (that is to say, which can be stopped and restarted at any moment, even when it is full with molten metal), in which the chemical composition can be modified at will thanks to the available access to the clean metal—for instance for adding an alloy forming metal—, which permits continuous removal of slag and which can be loaded with any dry metallic waste, while providing an optimized energetic performance.

SUMMARY

The disclosure therefore provides an improved furnace for melting and/or treating a wide variety of metals and metallic waste, the furnace having low consumption and high energetic and metallurgic performance thanks to its geometry and to its way of operation, in which the level of molten metal remains substantially constant.

According to an aspect of the present disclosure, a furnace is provided comprising a tank having an outer wall and an inner wall. The tank defines a closed canal between the inner wall and the outer wall. The tank is configured to, in use of the furnace, be filled with molten metal which will circulate along the closed canal in a continuous and cyclical manner.

The furnace comprises in said tank:

- at least one heating area comprising heating means configured to transfer energy to the molten metal thus overheating the molten metal;
- at least one loading area configured for loading metal or metallic waste to be melted or treated. The metal or metallic waste, in used of the furnace, is dragged by the overheated molten metal on its surface;

a melting/treatment area configured to receive the overheated molten metal and the metal or metallic waste dragged on its surface. The overheated molten metal transfers its exceeding energy to the dragged metal or metallic waste thus causing its melting/treatment.

The tank comprises a central hollow delimited by the inner wall. The furnace further comprises at least one driving means located within the central hollow. The at least one driving means comprises a rotor comprising at least two permanent magnets. The rotor is coupled to a motor and configured to rotate upon activation of the motor, thus generating a magnetic field capable of causing the circulation of the molten metal in a continuous and cyclical manner along the heating area, loading area and melting/treatment area. The power and distribution of the magnetic field generated is selected to affect most of the molten metal in the tank so as to move all the molten metal (with the metal and metallic waste on its surface) along the closed canal.

In a particular embodiment, the at least one loading area overlaps partially or totally with said at least one heating area.

In a particular embodiment, the melting/treatment area overlaps at least partially with said at least one heating area.

Preferably, the rotor is surrounded by a first thermal isolating body disposed between the rotor and an outer face of the inner wall of the tank which delimits the central hollow of the tank. The first thermal isolating body defines a first channel between the rotor and an inner wall of the thermal isolating body and a second channel between an outer wall of the first thermal isolating body and the outer face of the inner wall which delimits the central hollow or cavity. The furnace can also comprise blowing means for blowing air through the first and second channels to provide refrigerating air to the rotor in order to prevent the rotor from heating over a certain temperature (i.e. not higher than 80° C.). The first thermal isolating body is permeable to the magnetic field.

In a particular embodiment, the outer face of the inner wall of the tank, which delimits said cavity, is covered with a second thermal isolating body.

In an alternative embodiment, the outer face of the inner wall of the tank, which delimits said cavity, is made of a second thermal isolating body.

Preferably, the thermal isolating body is made of a material chosen from the following materials: stainless steel, mica, a composite material or a combination thereof.

In a particular embodiment, the heating means in said at least one heating area are placed substantially outside the effect of the magnetic field generated by the driving means. More preferably the outer wall of the tank defines an outer nose or protrusion so that the heating means are placed in said nose or protrusion. Still more preferably, the inner wall of the tank defines an inner nose or protrusion, so that said heating means is placed in the space defined by the inner and outer noses.

In a particular embodiment, the furnace further comprises an extraction area ending in a wall configured for preventing the progress of the slag, said extraction area comprising extraction means for pouring part of the molten metal and/or slag.

In a particular embodiment, the at least one melting/treatment area comprises retaining means whose lower part ends slightly above the level reached by the melted metal within the tank. The retaining means are configured for preventing the metal or metallic waste on the melted surface from travelling forward, so that the waste is substantially smelted on the surface of the molten metal bed, without preventing the progress of the molten metal beneath the retaining means.

The heating means is preferably a plasma torch.

Preferably, the angular velocity of the circulating molten metal is constant at the melting/treatment area (in the whole section of the melting/treatment area).

In another aspect of the disclosure, the use of the furnace previously described, is provided, for melting or treating ferrous or non-ferrous materials.

In a final aspect of the disclosure, a method for treating or melting metal or metallic waste in a furnace is provided. The furnace comprises a tank having an outer wall and an inner wall, said tank defining a closed canal between said inner wall and said outer wall. The tank comprises at least one heating area, at least one loading area and at least one treatment area.

The method comprises the steps of:

filling said tank with molten metal;

transferring energy to the molten metal thus overheating said molten metal (at the heating area);

loading metal or metallic waste to be melted or treated, said metal or metallic waste being dragged by the overheated molten metal on its surface (at the loading area);

receiving the overheated molten metal and the metal or metallic waste dragged on its surface, the overheated molten metal transferring its exceeding energy to the dragged metal or metallic waste (at the melting/treatment area);

circulating the molten metal along said closed canal in a continuous and cyclical manner, said movement being achieved by the action of at least one driving means located within a central hollow delimited by said inner wall of the tank. Said at least one driving means comprise a rotor, with at least two permanent magnets, the rotor being coupled to a motor and configured to rotate upon activation of said motor, thus generating a magnetic field capable of causing said circulation of the molten metal in a continuous and cyclical manner.

Additional advantages and features of the disclosure will become apparent from the detail description that follows and will be particularly pointed out in the appended claims.

BRIEF DESCRIPTION OF THE DRAWINGS

In the figures:

FIGS. 3A to 3C show side views of the furnace. FIG. 3D shows a top view thereof.

DETAILED DESCRIPTION OF THE DRAWINGS

In this text, the term "comprises" and its derivations (such as "comprising", etc.) should not be understood in an excluding sense, that is, these terms should not be interpreted as excluding the possibility that what is described and defined may include further elements, steps, etc.

In the context of the present disclosure, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially".

The following description is not to be taken in a limiting sense but is given solely for the purpose of describing the broad principles of the disclosure. Next embodiments of the disclosure will be described by way of example, with reference to the above-mentioned drawings showing apparatuses and results according to the disclosure.

In reference to the figures, a preferred embodiment of the furnace of this disclosure is described below.

The furnace of the disclosure is based on the indirect heating of the loaded material by means of a circulating molten metal which transfers the energy necessary for the melting or treatment of the loaded solid metal. This indirect heating is especially important when the material to be treated/melted is loaded in an area separate from a heating area. In some other cases, in which the loaded material can be in contact with or in the vicinity of the heating means (i.e. plasma torch), the heating means has a relevant contribution to the heating of the loaded material.

Figure 1:
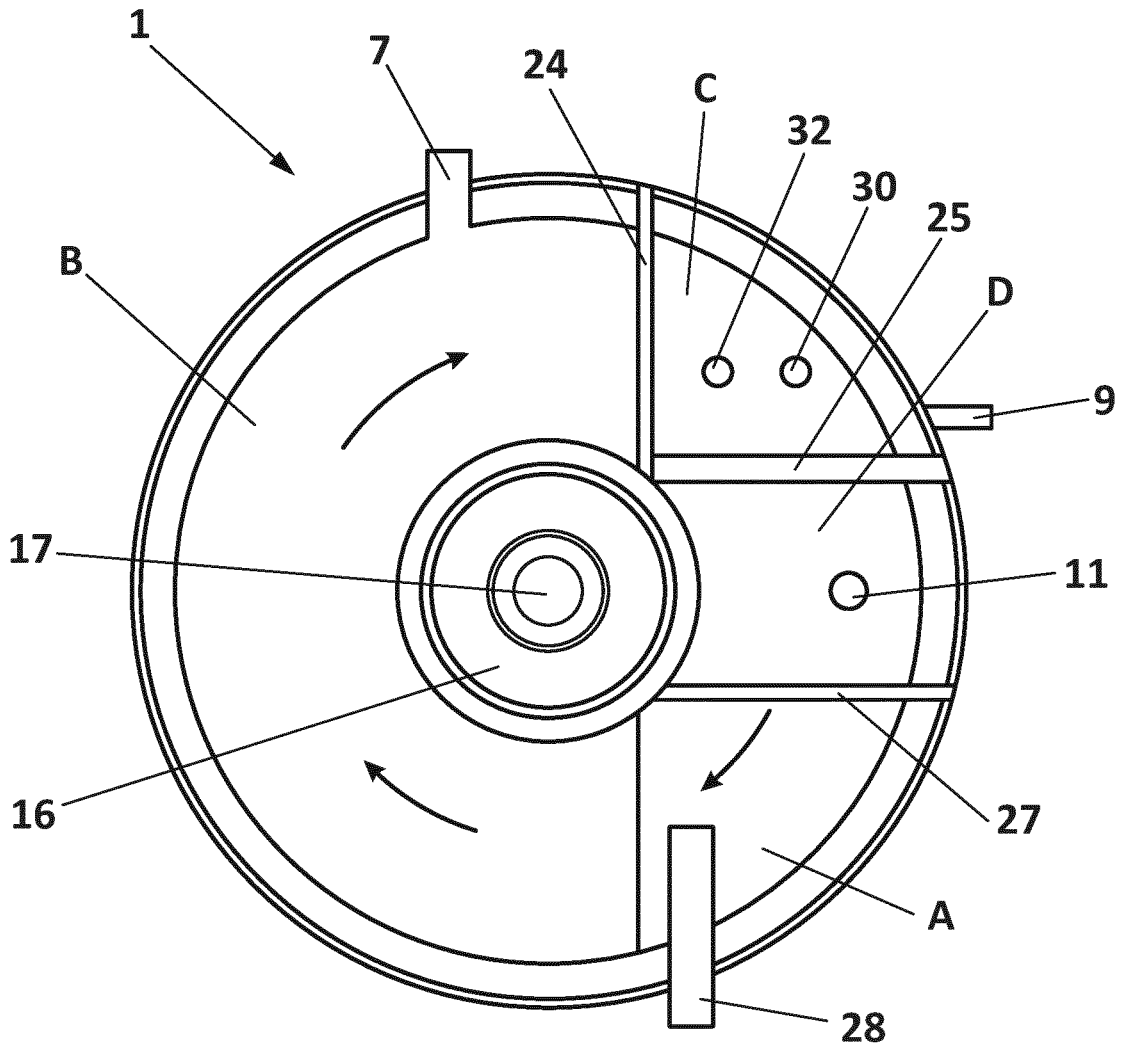
FIG. 1 shows a top view of the furnace according to an embodiment of the disclosure.
Figure 2:
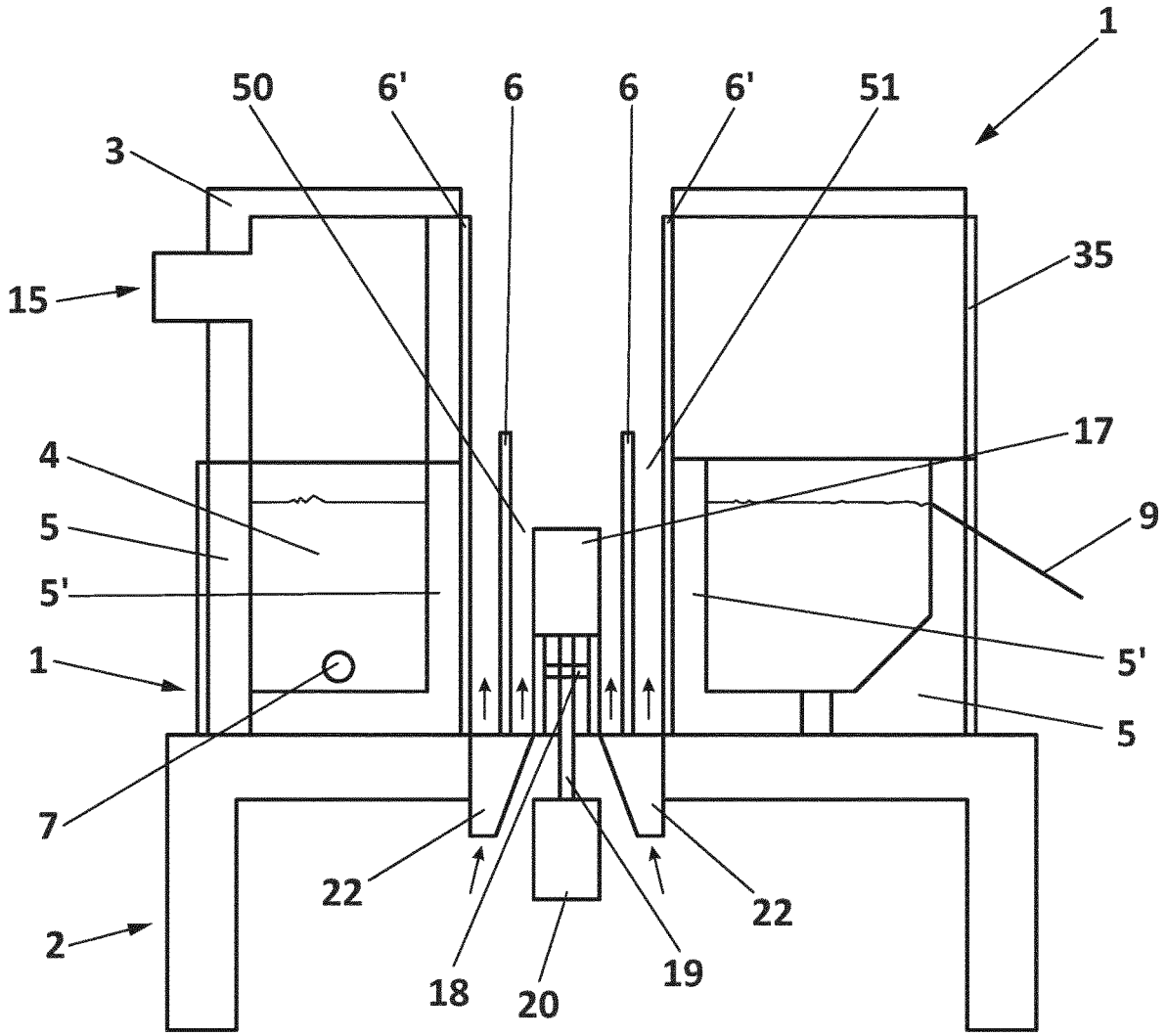
FIG. 2 shows a cross section of the furnace, its cover and its rotor, according to an embodiment of the disclosure.
Figure 3A:
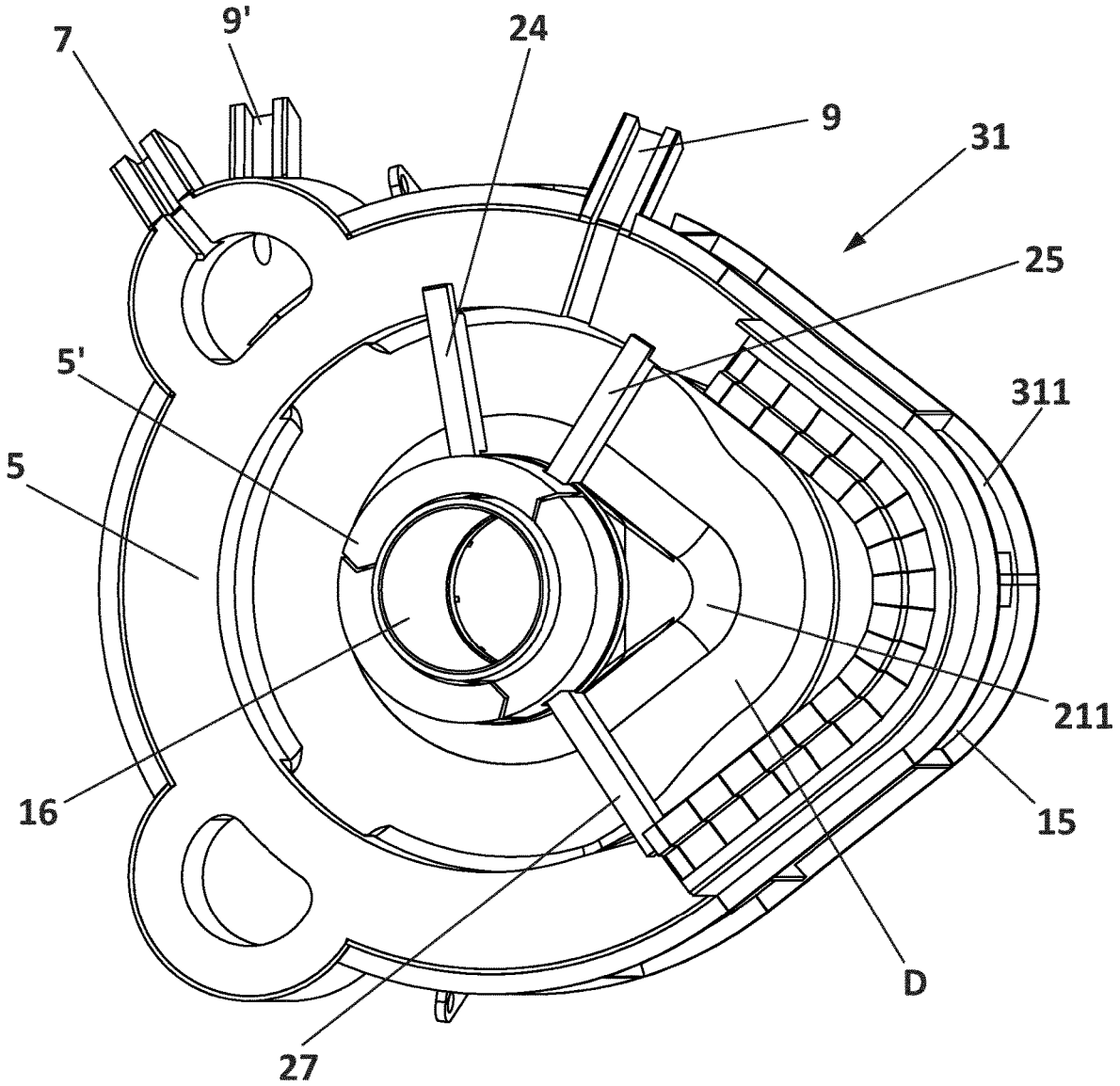
FIGS. 3A-3D show a most preferred embodiment of the furnace.
Figure 3B:
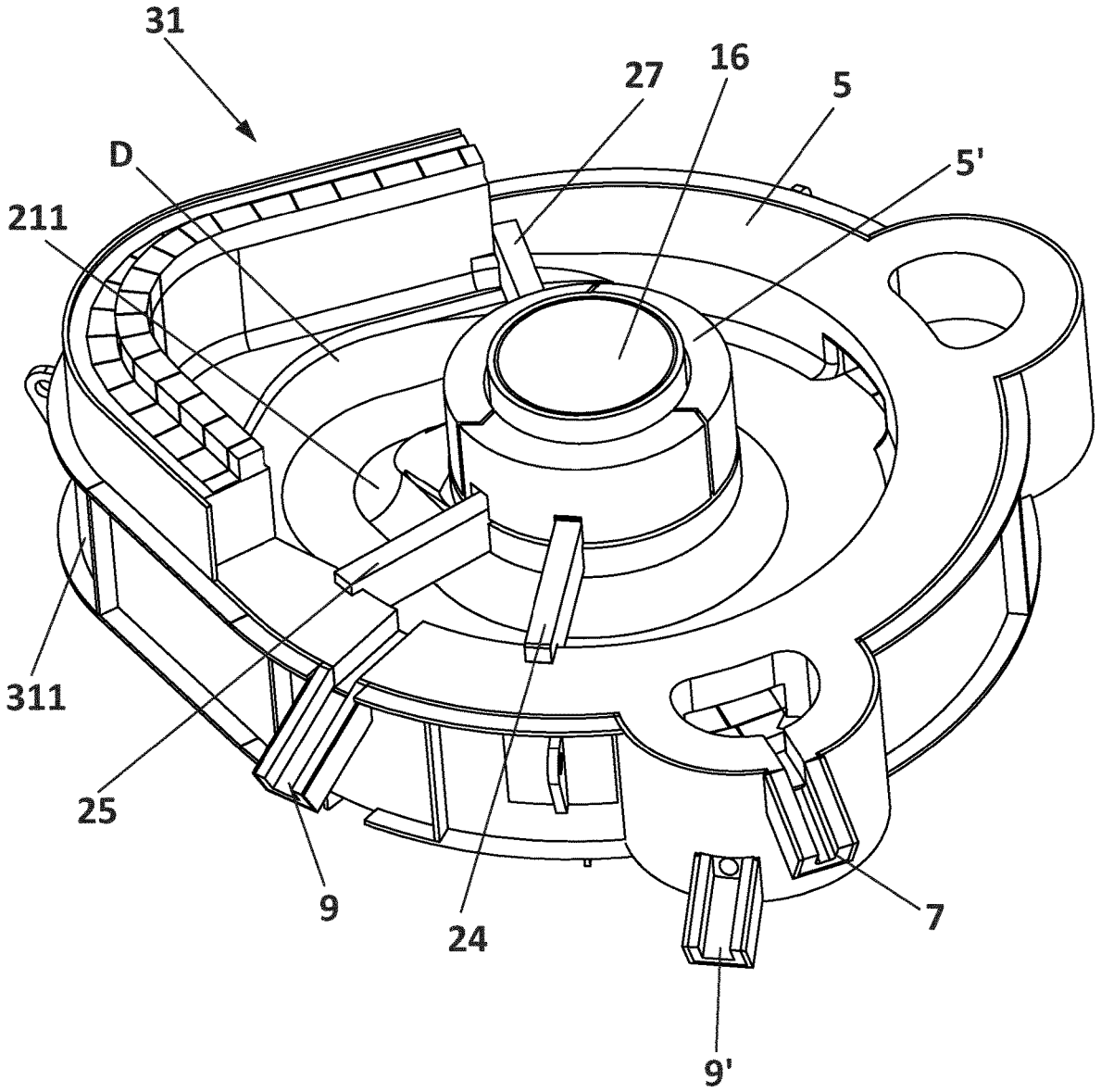
Figure 3C:
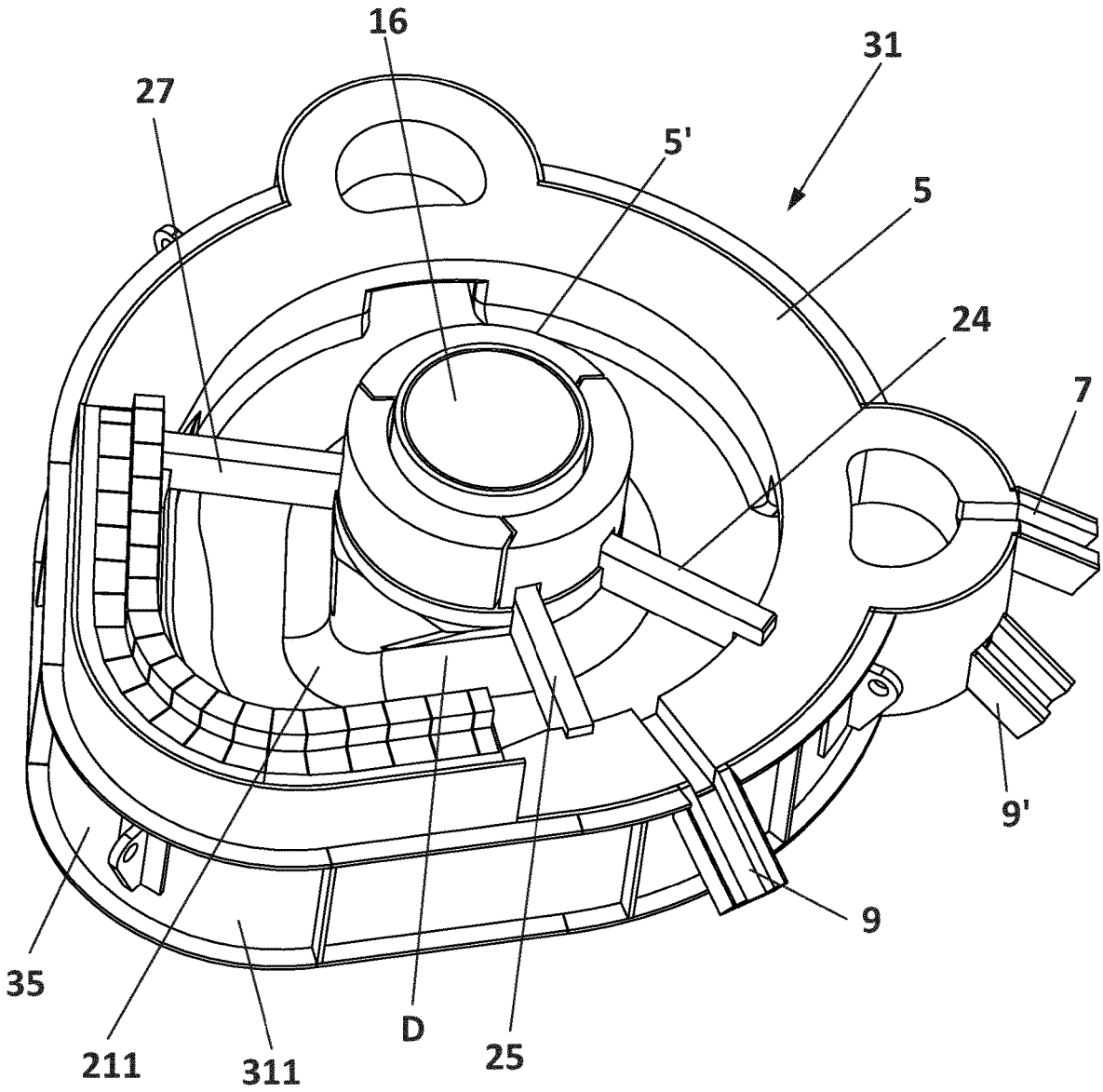
Figure 3D:
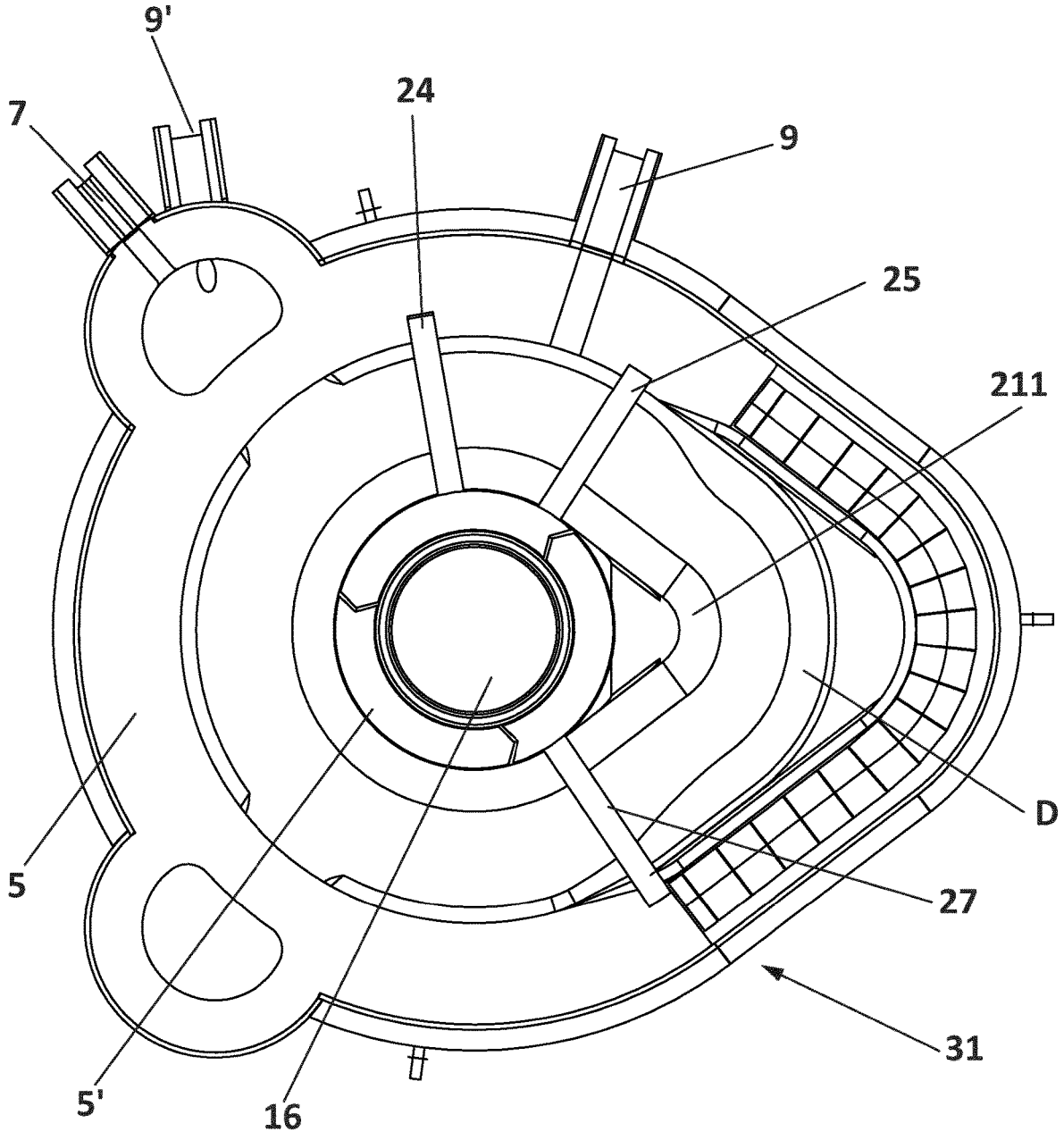

FIG. 1 shows a top view of the furnace according to a first embodiment of the disclosure. FIG. 2 shows a cross section of the furnace according to this embodiment of the disclosure. In FIG. 1 the covers or lids of the furnace have been removed in order to show the elements or parts which are within the tank 1 of the furnace. The main body 5 of the tank 1 is made of a refractory material adapted to the characteristics of the material to be melted/treated (ferrous or non-ferrous materials). Non-limiting examples of refractory materials which can be used are concrete or brick.

The tank 1 of the furnace comprises a closed-looped outer wall 5 and a closed looped inner wall 5' which delimits a central cavity or hollow (through hole) 16. Driving means 17 are housed within the cited central cavity 16. The driving means 17 is preferably a rotor 17 which comprises at least one magnet body having at least two permanent magnets. The rotor 17 is mounted on a vertical axis 19 which is coupled to an electric motor 20. This coupling can be either direct or indirect, for example by means of a pulley. There is preferably a cooling means 18 for cooling the motor 20 disposed below the rotor 17. The function of the rotor 17 is to create a constant magnetic field when it turns (rotates) around said axis 19 upon activation of the motor 20. The magnetic field thus generated causes the circulation of the molten metal in a continuous and cyclical manner along the closed canal defined by the tank 1.

Figure 7:
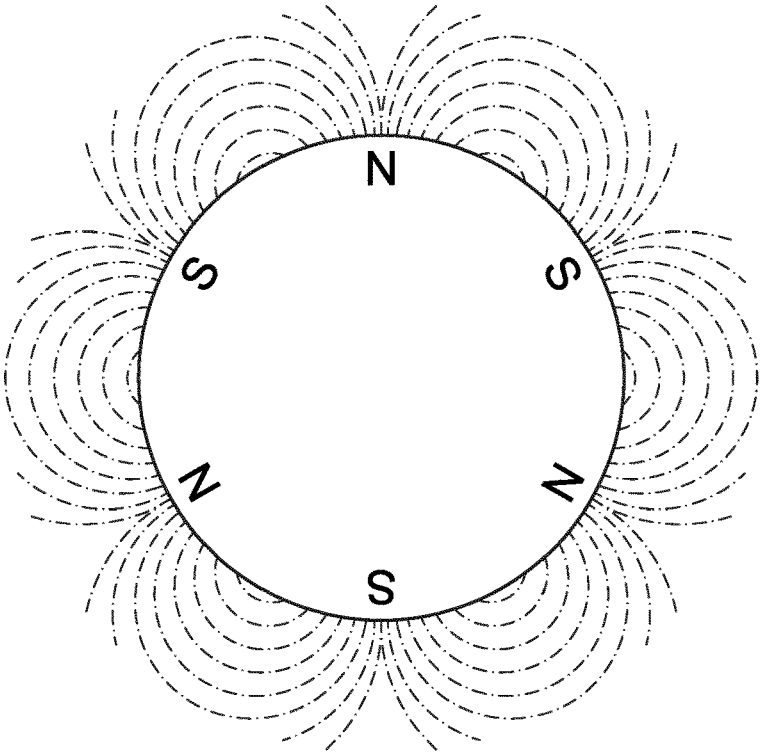
FIG. 7 illustrates a schematic representation of the force lines of the magnetic field generated by the rotor.

FIG. 7 illustrates a schematic representation of the force lines of the magnetic field generated by an exemplary rotor 17 having six poles. The molten metal in circulation acts as a travelling means for the metal or waste to be melted/treated and for the slag. The closer to the rotor 17 the molten metal is, the more the molten metal circulates due to the effect of the magnetic field generated by the rotor. However, the angular velocity of the circulating molten metal is constant for the whole volume of motel metal. In FIG. 2, reference 4 is used to refer to the molten metal 4 partially filling the tank's cavity. The furnace is suitable for melting/treating both ferrous and non-ferrous materials, due to the repelling effect applied by the alternating magnetic field to liquid (melted) metals, because these are nonmagnetic and conductive. The tank 1 is placed on a supporting element 2. Under the tank 1, second supporting means for the assembly formed by the rotor 17 and the motor 20 are placed (not illustrated).

The rotor 17 is preferably surrounded by (or housed within) a first thermal isolating body 6, shown in FIG. 2, which in a particular embodiment can take the shape of a cylinder. This cylinder 6 is placed between the rotor 17 and an outer face of the inner wall 5' of the tank 1. The rotor 17 is preferably sufficiently separated from the walls (or single circular wall, in the case of a cylinder) of said first isolating body 6 in order to define a first channel 50 which allows an air flow to pass (indicated by arrows in FIG. 2). In other words, the hollow cylindrical wall of the isolating body 6 forms in its inner face, an evacuation chimney for the air flow (refrigerating air). In its outer wall, the isolating body 6 is preferably sufficiently separated from the outer face of the inner wall 5' of the tank 1 to define a second channel 51 which allows also air to flow. Such air flow preferably comes through corresponding blowers 22, preferably low-pressure blowers.

Figure 8:
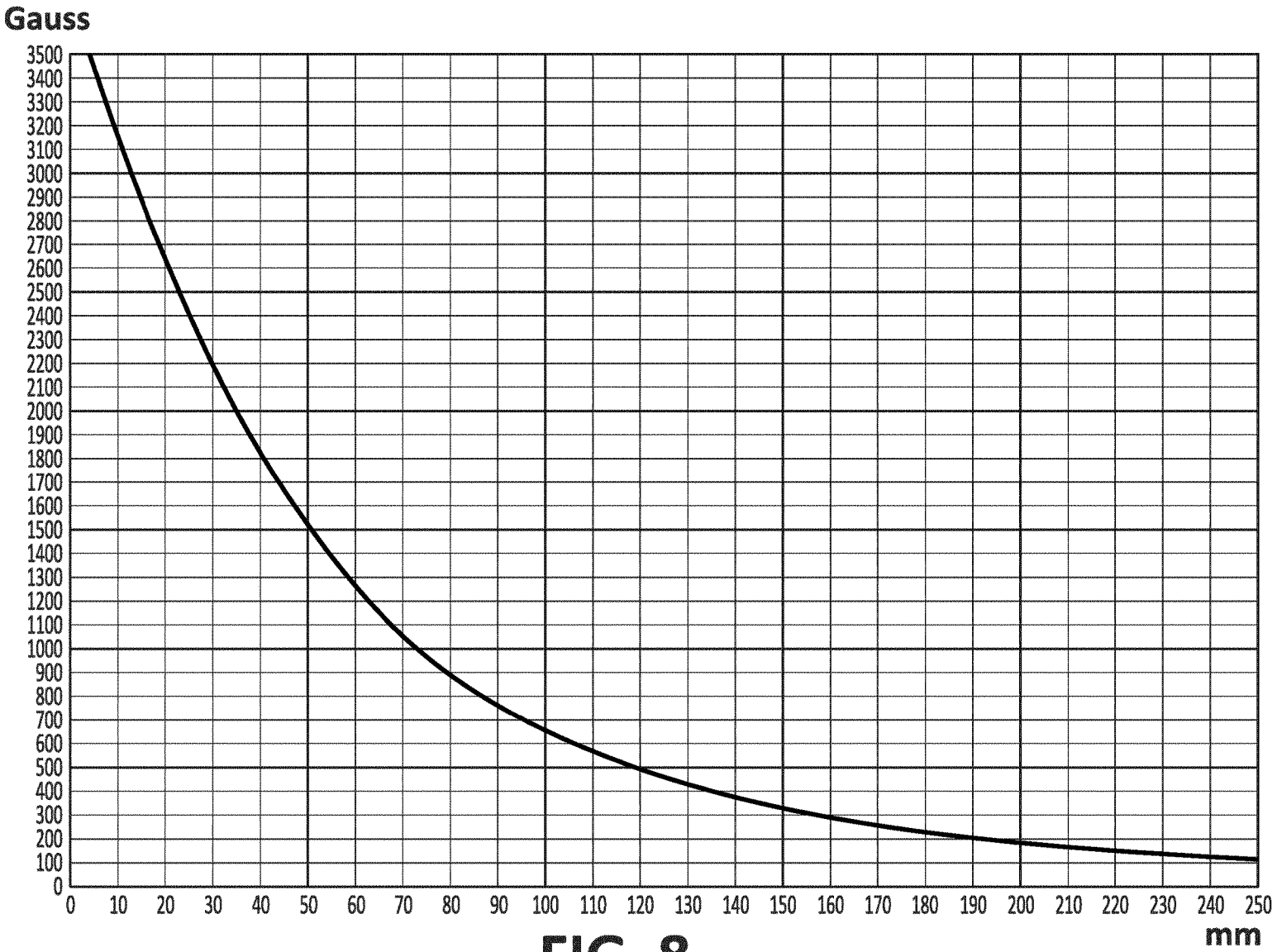
FIG. 8 shows a simulation of the intensity of the magnetic field as a function of the distance to the rotor.

The thermal isolating body 6 is permeable to the magnetic field. The isolating body 6 comprises a nonmagnetic material which supports high temperatures (up to 700° C.). Non-limiting examples of such material are stainless steel, mica or a composite material, among others. The purpose of this thermal isolating body 6 is to guarantee that the temperature around the rotor 17 is not higher than about 80° C. and to shield the radiation of the furnace. The height of the isolating body 6 is at least that of the rotor 17. It can also be higher than the rotor 17. FIG. 8 shows a simulation of the intensity of the magnetic field (Gauss) produced by a magnet with respect to distance.

Conventional furnaces normally have a metallic wall or sheet 35 externally covering the refractory body (which is normally concrete or brick), as shown for example in FIG. 2. In a preferred embodiment, however, such metallic wall or sheet has been removed from the outer surface of the inner body wall (that is to say, the part which in FIG. 2 is closer to the isolating body 6). Instead of such metallic wall or sheet, a second thermal isolating body 6' for thermal isolation has been disposed to cover the refractory tank's body. In other words, the metallic wall is replaced by a wall of second isolating material, preferably comprising stainless steel, mica, a composite material or a combination thereof. Thus, the second thermal isolating body is in contact with the refractory wall 5' of the furnace. In an alternative embodiment, the second thermal isolating body 6' is added to the metallic wall, which is not removed.

This second thermal isolating body 6' is shown in FIG. 2. This second isolating body 6' contributes to achieving the desired temperature around the rotor 17 (temperature not exceeding about 80°). In a preferred embodiment, the second isolating body 6' is made of mica.

In use of the furnace, the tank 1 is filled with molten metal (4 in FIG. 2). In the shown embodiment, the furnace has a loading area A for loading (solid) metal SM or metallic waste R to be melted or treated into the tank 1. Alternative embodiments of the furnace can have more than one loading areas A. As already explained, the driving means 17 generates a movement of the molten metal in a continuous and cyclical manner inside the tank 1. By changing the velocity of rotation of the rotor the velocity of the circulating molten metal can be adjusted by an operator. As it moves, the molten metal drags the solid metal SM or metallic waste R. The arrows in FIG. 1 represent the direction of movement of the molten metal within the tank 1. The molten metal and loaded metal SM or metallic waste R travel towards a melting/treatment area B in which the metal or metallic waste is melted/treated as a consequence of the heat exchange and the movement of molten metal. Depending on the configuration of the furnace, there can be one or more than one melting/treatment areas B. The angular velocity of the circulating molten metal is constant for the whole volume of motel metal at least at the melting/treatment area B. The angular velocity is constant both at the surface and within the tank 1.

In the embodiment shown in FIG. 1, the furnace comprises a heating area D comprising heating means 11. Alternative embodiments of the furnace can have more than one heating areas D. In the shown embodiment, the heating area D is preferably located before the loading area A, thus increasing the treatment performance because in the vicinity of the heating area the molten metal reaches its highest temperature. Alternatively, the loading area A can be within the heating area D. In a preferred embodiment, the heating means 11 is a plasma torch. The plasma torch is normally supported by a supporting element, not illustrated, on which the torch is mounted. This supporting element permits the electrode (of the torch) to turn up to 180° in order to permit a change of electrode. The electrode is a conventional one, such as one made of graphite. The energy provided by the heating means 11 is transferred to the molten metal bed, which circulates in a closed loop. In this heating area or chamber D, the molten metal (metal bed) is overheated with respect to the tapping temperature, in such a way that the overheated molten metal can pass the exceeding energy over the solid metal SM or metallic waste R during its circulation. The temperature of the process is adjusted and controlled by reading the tapping temperature. Depending on the value of the tapping temperature, the power applied by the heating means 11 and/or the volume of load (solid metal SM or metallic waste R) loaded now and then into the furnace is increased/reduced. The furnace also comprises at least one fume extraction outlet 15 shown in FIG. 2.

In the embodiment shown in FIG. 1, the furnace also comprises a slag and metal extraction area C arranged after the melting/treatment area B and before the heating area D. This slag and metal extraction area C comprises extraction means 9, such as a tapping spout, for pouring the slag and molten metal which exceeds the level of this tapping spout. Slag floats on the surface of the extraction area C. The slag circulates towards the tapping spout 9. Alternatively, the extraction means can be formed by two separate tapping spouts 9 9' (shown for example in FIGS. 3A-3D), for separately extracting the slag from the molten metal. This permits to perform a strict control on the temperature of the system, by controlling the temperature of the molten metal and thus preventing damage on the refractory wall. The control on the temperature of the molten metal also permits to regulate the amount of metal SM or metallic waste R loaded onto the molten metal bed. The performance of the furnace is thus optimized. Preferably, at the extraction area C there is also a thermocouple 32 (or even an optic thermocouple) for controlling the molten metal temperature. The slag and metal is extracted at this area C, so that the molten metal surface is slag-free when it reaches the heating area D and the loading area A. This increases considerably the performance of the circulating metal heating and the heating transfer to the loaded material. As can be observed, the heating means 11 is arranged after the slag and metal extraction area C, such that the molten metal has a substantially homogeneous temperature on its surface when it reaches the loading area A.

The furnace can have different walls, disposed between the main body 5 (or outer wall 5) of the tank 1 and its inner wall 5', associated to the different working areas in which de furnace is divided. In other words, the walls are transversal to the flow or movement of the molten metal. Depending on the height of each wall with respect to surface of molten metal bed, each wall will permit or not the travel of, the slag and/or the solid metal or waste dragged by the molten metal. The molten metal always passes down the walls. In the embodiment of FIG. 1, separating wall 27 delimits the heating area D, in order for the heating means 11 to be isolated from the rest of the furnace. Separating wall 27 is optional. The reason for having separating wall 27 is to close the heating area D, in order for preventing radiation from leaving said area D. Separating Wall 27 preferably separates the loading area A from the heating area D. The lower end of this separating wall 27 is approximately at the same height as, but slightly above, the level of the molten metal bed. In particular, the lower end of separating wall 27 is preferably at a height such that solid material loaded is prevented from going backwards into the heating area D from the loading area A while the slag that might be generated in the heating area D is allowed to leave said heating area D. In other words, if the loading process in the loading area A is optimized, separating wall 27 is not required. The lower end of wall 27 is slightly above the surface of the molten metal bed. Preferably, the lower end of wall 27 is at the most 5 mm above the level of molten metal. That is to say, there is a minimum gap of 5 mm between the lower end of the wall 27 and the level of molten metal. The circulating molten metal heats up, drags and melts the loaded material along the closed loop (melting/treatment area B). At the end of this melting/treatment area B, there can be retaining means 24, preferably in the form of a retaining wall. The slag and metal extraction area C is delimited by a siphoning wall 25 which penetrates (is slightly submerged) within the molten metal down to a certain depth, preferably up to 40 mm, thus preventing the travel of the slag towards the heating area D. This siphoning wall 25 permits the extraction of slag (through the tapping spout 9) in a continuous way and prevents its travel towards the heating area D. The circulation circuit (loop) is thus closed. There can be an emptying spout 7 located at any area for emptying the tank 1 if required As already mentioned, in a particular embodiment, the melting/treatment area B comprises waste retaining means 24. In this embodiment, when the metal SM or metallic waste R travelling on the surface of the molten metal X reaches the retaining means 24, this does not allow the floating solid metal SM or floating metallic waste R having height above the lower end of the retaining means 24, to pass, whereas the molten metal X together with the metallic particles it may contain, continues its movement beneath the solid metal SM or metallic waste, causing the complete melting/treatment of the solid metal SM or metallic waste R, as will be described next. In other words, the retaining means 24 is for retaining such waste or solid metal on the surface of the circulating metal. The retaining means 24 can be implemented as a wall supported or leant against the inner surface of the tank 1. Preferably, the lower end of the retaining wall 24 is at the most 2 mm above the level of molten metal. That is to say, there is a minimum gap of 2 mm between the lower end of the retaining wall 24 and the level of molten metal. This height depends on the size of the metallic waste or solid metal SM to be melted/treated and varies depending on the type of metallic waste or solid metal.

The furnace shown in FIG. 1 represents a basic embodiment. The furnace can have a modular design, in such a way that the basic embodiment can be repeated as many times as necessary depending on the quantities of metal/metallic waste to be treated/melted, but always with a single closed loop along which the same molten metal circulates.

In the embodiment shown in FIG. 1, different areas (loading area A, melting/treatment area B, extraction area C and heating area D) have been defined. Specific characteristics of these areas depend on the specific characteristics of the different materials to be melted/treated. Thus, the location and size of those areas are configured with the purpose of obtaining an optimized performance of the furnace during operation (specific power consumption, metallic recycling and refractory wall wear). Waste to be treated is usually characterized by its nature, composition, way of being loaded and/or requirements and evolution during treatment/melting. Thus, different specific embodiments of the furnace can be implemented, depending on the waste to be treated and its characteristics.

The embodiment shown in FIG. 1 can be used for treating/melting materials having high metallic content (which normally melt relatively quickly) and high gaseous evolution. A non-limiting example of such materials is EAF (electric arc furnace) dust. These materials can be processed (treated) at the melting/treatment area B by means of the energy provided by the circulating molten metal. For such materials, which normally generate a relatively large amount of slag, the implementation shown in FIG. 1 is used. In particular, the treatment of EAF dust requires the presence of the two walls 24 25: wall or retaining means 24, at the end of the melting/treatment area B, for retaining waste or solid metal on the surface of the molten metal bed; and siphoning wall 25, for preventing the travel of the slag towards the heating area D. A separating wall 27 can optionally be implemented for, in case of overload in the loading area A, preventing that part of the loaded material travels in countercurrent towards the heating area D. The load of material in the loading area A is controlled for preventing overloaded material from reaching the heating area D. Separating Wall 27 is also for isolating the heating means 11 from the rest of the furnace and thus preventing radiation from leaving said area D.

If, on the contrary, the material to be treated/melted is clean enough and therefore does not generate large amounts of slag, the treatment/melting area B can include one or more supplementary plasma torches in a zone at this area B furthest away from the loading area A. Non-limiting examples of such materials are scrap, metallic shavings, copper oxide or iron oxide. This is because, due to their little gaseous evolution and low melting point, such materials can be subject to the action of the plasma torch without evaporating. For this reason, the loaded material can be in contact with or in the vicinity of the plasma torch. That is why the loading area A and/or the melting/treatment area B can overlap (partially or totally) with the heating area D. These materials require also the presence of two walls: wall or retaining means 24 and siphoning wall 25, for preventing the travel of the slag towards the heating area D.

In another alternative embodiment, the furnace is used for melting/treating material having high melting/treatment point and little gaseous evolution, such as asbestos, waste from automobile catalyst, which are normally combined with ceramics, petrochemical waste with high degree of molybdenum. These materials are preferably loaded (A) at the heating area D, either through the plasma torch (which is hollow) or in the vicinity thereof. In this same area the materials are processed (treated or melted). The furnace is therefore preferably configured with a main chamber/area for heating and treating, and with a small extraction area C at the end of the main area. In this case, only siphoning wall 25 and separating wall 27 are strictly required, for respectively preventing the travel of the slag towards the main area (for heating, leading and treating) and for acting as retaining means.

In another alternative embodiment, used for melting or treating material having high gaseous evolution and high temperature of treatment/melting, the material must be loaded (loaded area A) in a chamber prior to the heating area (D) and following the extraction area C. The heating area D can overlap partially with the treating/melting area B because the material can be treated/melted at both areas. Therefore, for such materials, siphoning wall 25 and separating wall 27 are required. It is remarked that, in this embodiment, separating wall 27 works as retaining means.

Figure 5:
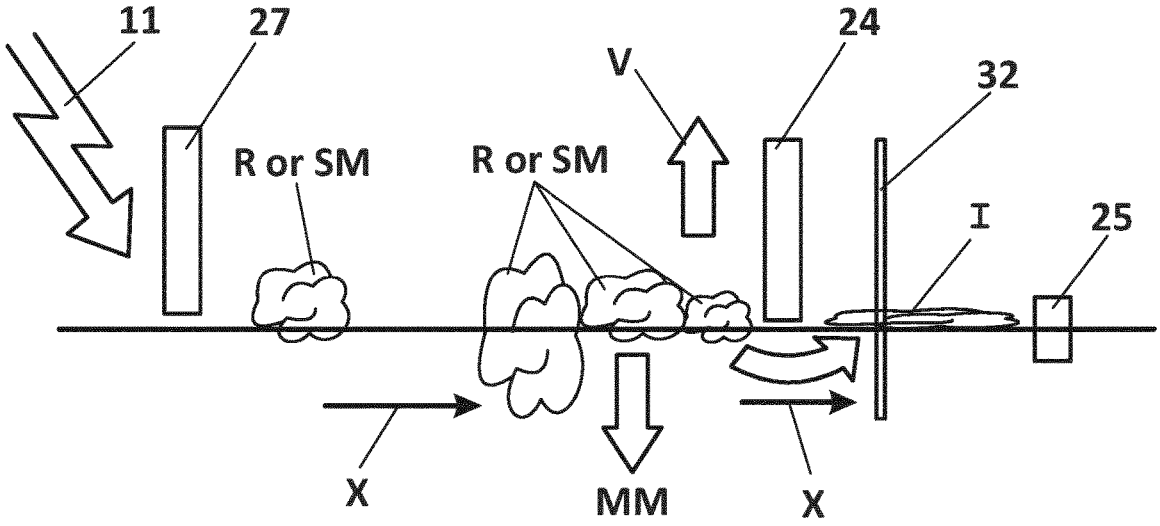
FIG. 5 shows a lineal view of the melting or treatment of solid metal or metallic waste and the position and functioning of walls and other elements of the furnace.

FIG. 5 shows a lineal view of the melting or treatment of solid metal or metallic waste and the position and functioning of walls and other elements of the furnace according to the embodiment illustrated in FIG. 1. The horizontal line represents the level of molten metal within the tank. The first element is the heating means 11 (preferably a plasma torch) located at a heating area. The plasma torch 11 remains above the molten metal bed. Optional separating wall 27 delimits the end of the heating area. The lower end of this separating wall 27 is slightly over the level of the molten metal bed. The metal SM or metallic waste R is loaded after separating wall 27, so this wall prevents the loaded material form going backwards into the heating area. The metal SM or metallic waste R is dragged by the circulating molten metal X in the direction of the arrows. When the circulating molten metal X, which drags the metal SM or metallic waste R, reaches retaining means 24, the retaining means 24 prevents the metal material not melted from travelling forward, while allowing the progress beneath the retaining means 24 of the scrap, and molten metal). Retaining means 24 are also optional, since it is only necessary at certain uses of the furnace. As illustrated in FIG. 5, the soluble metal fraction MM is incorporated in the molten metal bed, whereas the volatilizable fraction V—if any—will move on to a treatment/melting and extraction phase that comprises filtering fumes and recovering the valorizable part. The fraction I that is non-soluble at the temperature of the metal bed and non-volatilizable, moves on to the surface of the molten metal bed in the form of slag I.

The retaining means 24 are designed in such a way that its lower part ends slightly above the level reached by the molten metal X within the tank 1. In other words, the retaining means 24 ends at a level with respect to the level of the molten metal X which is higher enough to let slag I go forward but to prevent solid metal MS from going further. It is located at a distance from the metal bed which can vary (depending on the use for which the furnace is intended). Its goal is to prevent the travelling forward of the floating rests before its substantially total melting. The height of retaining wall 24 depends on the size of the metallic waste R or solid metal SM to be melted/treated and varies depending on the type of metallic waste R or solid metal SM. The molten metal X having floating slag I on its surface travels along the closed canal defined by the tank. If the molten metal level exceeds the height at which a tapping spout is (or tapping spouts are), the exceeding amount of molten metal leaves the tank through tapping spouts (not shown in FIG. 5). The floating slag does not leave the tank, but travels forwards until it reaches retaining means 24, whose lower end is, as shown in FIG. 5, slighter above the level of molten metal. This disposition of the retaining means 24 permits the slag I go forward but prevents solid metal MS from going further. Therefore, the slag I travels forward until it reaches the siphoning wall 25.

Siphoning wall 25 delimits a metal extraction area and is slightly submerged into the molten metal bed. It penetrates within the molten metal down to a certain depth, thus preventing the travel of the slag I towards the heating area. If there are two tapping spouts 9 9', the exceeding molten metal is extracted by one of them and the slag is extracted by the other one. If there is a single tapping spout, molten metal and slag are extracted by that single spout. Thus, the substantially slag-free molten metal reaches the heating area. Separating wall 27 delimits the end of heating area in which the plasma torch 11 is located. FIG. 5 also illustrates a thermocouple 32, partially submerged in the molten metal bed.

Figure 4:
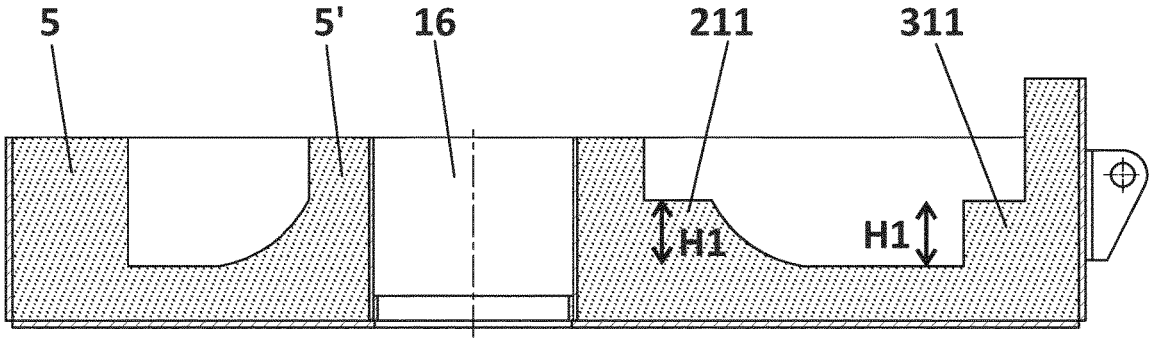
FIG. 4 shows a section view of the furnace of FIGS. 3A-3D.

FIGS. 3A to 3D and 4 illustrate a preferred embodiment of the tank 31 (lids or covers not shown). The outer perimeter of the tank 31 is a circular wall 5 which has been modified in such a way that at the heating area D, that is to say, at the area in which the heating means 11 is located, the outer wall 5, instead of being exactly circular, moves away with respect to the inner wall 5', thus defining a protrusion or nose 311. In a most preferred embodiment, the inner perimeter of the tank 31, which is originally also a circular wall 5' defining the cavity 16 in which the driving means 17 is placed, has also been modified like the outer perimeter of the tank, defining a similar protrusion or nose 211. Preferred implementations of these protrusions 211 311 are described next, with reference to FIG. 4. In the embodiment of FIGS. 3A-3D a double extraction means 9 9' is shown, for separately extracting (tapping) slag and the molten metal respectively which may exceed a certain level H1, which is the level at which tapping spout 9 is in the embodiment having a single tapping spout and at which tapping spout 9' is in the embodiment having two separate tapping spouts. If there are two tapping spouts 9 9', the exceeding molten metal is extracted by one of them and the slag is extracted by the other one. Thus, the substantially slag-free molten metal reaches the heating area. Alternatively, a single extraction means 9 (for example tapping spout) could be used instead, as shown for example in FIG. 1. An emptying spout 7 is also shown, for emptying the tank 1 when required. FIG. 4 shows a preferred implementation of protrusions 311 211. The inventors have observed that this configuration optimizes the performance of the furnace, because the magnetic field generated by the driving means 17 when it is under operation does not affect the performance of the heating means 11, which is preferably a plasma torch.

While the angular velocity of the circulating molten metal is constant for the whole volume of motel metal at the melting/treatment area B, in the heating area D the velocity due to the magnetic field is much lower because the magnetic field is much lower at this area (see for example FIG. 8, which represents the behaviour of the magnetic field with distance). In this zone of the canal where this protrusion is, the molten metal circulates mainly due to the dragging force applied by the rest of the molten metal.

In an alternative embodiment, the isolation of the heating means 11 from the effect of the magnetic field generated by the driving means 17 is achieved by means of a different configuration of the furnace. Instead of having a protrusion 311 (or protrusions 211 311), the width of the canal forming a closed loop (defined by the two walls of the tank) is constant, but thick enough so as to have substantially no influence of the magnetic field generated by the driving means 17 at the heating means 11 located at the heating area D. In this embodiment, the linear velocity of the circulating molten metal is not constant any more, said linear velocity being lower at the outer part of the canal.

In a preferred embodiment, the furnace has two covers or lids, not shown: a first cover which covers the melting/treatment area and a second cover which covers the heating area. The lid or lids permit the access of one or more gas burners, for example for preheating and/or for supplying additional energy to the heating means 11. The different walls 24 25 27 can be either fixed to the tank or to the lid or lids.

Operational melting or treatment in a furnace, such as the mode for carrying out the disclosure of FIG. 1 or 3A-3D, where appropriate, begins with the start of the motor 20 for rotating the magnetic rotor 17 and the blower or blowers, and continues with preheating of the furnace vessel and the plasma chamber (heating area D) with gas burners until achieving a temperature on the surface of the refractory furnace (tank 1 31) adjusted to the material to be processed. When the desired temperature is reached, the canal of the tank 1 31 is filled with molten metal by using a transfer ladle. The volume of molten metal must be sufficient to completely fill the canal up to its overflow through the tapping spout (tapping spout 9' in FIGS. 3A-3D). The excess metal fills a siphoning crucible located on a lower vertical plane to the spout and is maintained in a liquid state with auxiliary heating means (for example, an induction coil or gas) in the case of there being a single spout. In the case of having two spouts, the excess metal overflows through 9' and goes to a casting mould.

After adjusting the rotational speed of the molten metal the plasma torch 11 is activated to raise the temperature of the metal until the melting or required treatment is reached and, once achieved, the loading of solid material R (or SM) starts, which is melted by contact with the molten metal stream X in its circulation towards the tapping spout. The incorporation of this metal causes the bath level (molten metal bed) to rise and overflow of the same occurs in the tapping spout, by dragging the floating slag I with it, in the case that a single common tapping spout is used. In this case, the mixture of metal and slag is separated into the exterior siphon (not shown), which pours two separate streams of clean metal and slag. Alternatively, if two tapping spouts 9 9' are used, the floating slag is extracted from the tank in the second tapping spout 9.

To ensure proper operation of the process, the furnace preferably has the two walls described, placed next to the tapping spout or spouts. The first one (wall 24) is located in the area immediately above the spout (or first spout 9' in the case of two spouts) with respect to the direction of the stream and at flush level with the height of the bath. As explained, its aim is to retain the still unmelted load residue that may remain floating. These remains end up melting by the combined action of the forced convection provided by the circulating metal on a static element and optionally by direct heating of, for example, a low power gas burner situated over the retaining wall 24 itself. The siphoning wall 25 is placed in the rear area of the outlet spout (or between the two spouts 9 9', in the case of two) with respect to the direction of the metal and in the bath its level sinks to a depth sufficient to prevent passage of the slag into the heating chamber D but allows recirculation of metal. In the case of having two tapping spouts 9 9', at its outer end this siphoning wall 25 is directly connected with the second tapping spout 9, through which slag flows by being poured into a separating siphon.

The substantially slag-free circulating metal enters the heating chamber D, wherein its temperature is raised to the necessary and sufficient extent to melt the solid material which is loaded in the area where the metal leaves said chamber (loading area A), thus initiating again the cycle of melting/treatment and dragging of the loaded material and closing the cycle of melting and casting. This process is automatically controlled by controlling the tapping temperature, for which purpose preferably a thermocouple 32 is used. The increase or decrease of the tapping temperature becomes a parameter indicative of the progress of the process and allows the operator to select the operating parameters according to priority needs of the same. The increase or decrease of the set tapping temperature is corrected by adjusting the volume of the load introduced, by increasing or reducing the applied power, or by a combination of both.

The process described allows for the use of the furnace in a discretionary way, since, after priming with liquid metal, it can be kept waiting for a solid load during the time necessary. To do this, it is sufficient to adjust the heating power required to maintain the metal at a suitable temperature and adjust the rotation speed to the minimum required for this operation. Since the siphon incorporates its own heating system, the melting process can be interrupted and resumed at the operators will, without any negative consequences to the furnace operation.

Figure 6A:
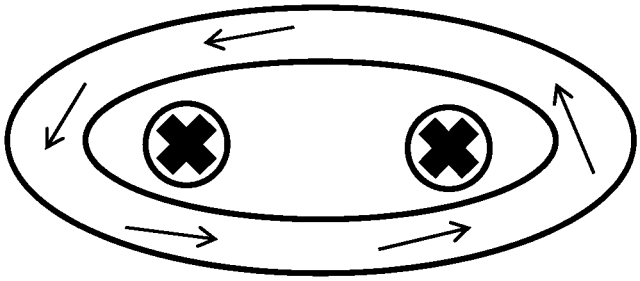
FIGS. 6A, 6B, and 6C show possible alternatives of the geometry of the furnace, including configuration of the rotors.
Figure 6B:
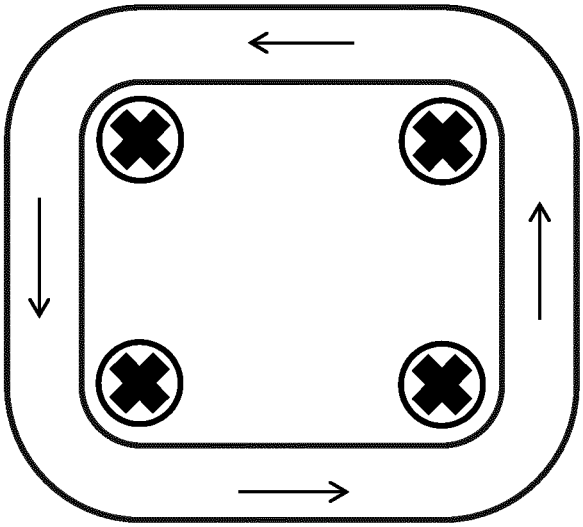
Figure 6C:
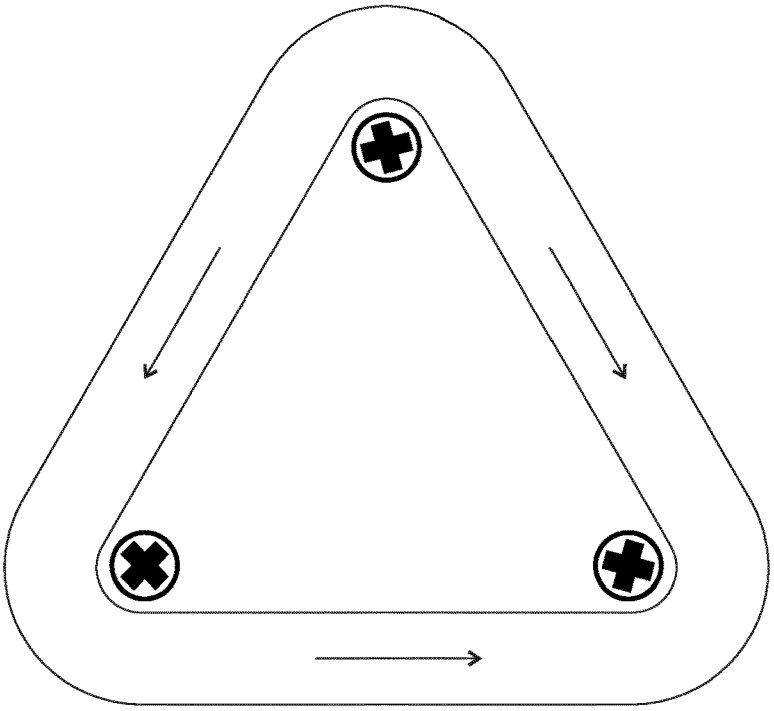

FIGS. 6A, 6B and 6C show possible alternatives of the geometry of the furnace, including configuration of the rotors. For example, in FIG. 6A a furnace having elliptical geometry is shown. In order to achieve the circulation of the molten metal, two rotors have been foreseen, substantially at the end of the larger radius of the ellipse defined by the tank. In FIG. 6B a furnace having substantially squared shape is shown. Four rotors have been foreseen, at corresponding corners of the hole cavity defined by the tank. Finally, FIG. 6C shows a furnace having triangular geometry, in which three rotors have been foreseen, at corresponding corners of the hole cavity defined by the tank. Non-limiting examples of additional suitable geometries are circular, elliptical or polygonal ones, provided that they comprise an outer and inner turning radius for permitting the metal circulation. The section of the closed loop is preferably substantially constant. The configurations may need more than one heating area and corresponding heating means. The heating means must be placed far enough from the rotors, for the magnets not to affect the heating means. In preferred embodiments, the heating means (preferably plasma torches) are located in the closed canal, at equidistant distance from the rotors. The distance is high enough for the torches not to be affected by the magnetic field of the rotors. For this reason, protrusions 211 311 are optional and not strictly required.

The disclosure provides a multidisciplinary melting furnace, suitable for melting and treatment of a wide variety of metals and waste with operational, economic and environmental advantages over currently used furnaces. The high energy efficiency of the furnace of the disclosure is due to the combination of several factors: a) heating occurs preferably through highly efficient plasma arc; b) the circulation of the molten metal under the plasma arc increases the degree of heat transfer; c) the water cooling circuit is preferably limited to the flanges of the electrodes (outside the furnace, so there is no cooling in the furnace itself); d) the magnetic rotor is cooled by air at low pressure; e) the motor which drives the metal movement is low power; f) the addition of the load to a stream of liquid slag-free metal allows the melting of materials with different forms and structures; g) the furnace is suitable for practically all types of metal melting (iron-, copper- and aluminium-based metals, among others); h) its geometry can be adapted to the needs of the smelter; i) the furnace can operate in automatic mode and does not require any interior manipulation nor opening of gates or inspection traps at any stage of the process; (j) its use is completely discretionary, and may operate as a continuous or discontinuous furnace; k) the stirring of the metal permits the continuous adjustment of the chemical composition by adding alloy-forming elements is possible.

An experiment carried out with a furnace implemented according to FIGS. 3A-3D is disclosed. The tank defines a canal (closed loop) of 300 mm width. The canal has 110 mm depth and it is loaded with 600 Kg of molten metal. The molten composition is (percentages expressed by weight with respect to the total weight of the molten composition):

| | |
|---|---|
| C | 3.60% |
| Si | 2.20% |

the rest of the chemical composition being Fe and other residual elements.

The temperature of the molten metal varies between 1,350 and 1,580° C. The rotor comprises one magnet body having 4 neodymium magnets. The magnetic field at the lateral surface of the rotor (area of maximum magnetism) is 4300 Gauss. The magnetic field at the inner wall of the tank (area of maximum magnetism within the tank) is 380 Gauss. The magnetic field at the outer wall of the tank (area of minimum magnetism within the tank) is 30 Gauss. The linear velocity at the axis of the canal of the molten metal is 18 cm/s at 40 Hz of rotating frequency of the rotor Next two examples of application of the furnace are described. First, we describe how the furnace can be used for melting a metal (in particular, iron). Then, we describe how the furnace can be used for treating steel dust.

Example 1: Melting Process: Iron

The use of the present furnace as a smelting furnace is based on the significant improvement of performance in heat transfer by convection caused by the constant movement of the molten metal around a solid mass. In a static bath of molten iron, the convection coefficient is 1,000 W/m2K, however, this coefficient increases due to the movement of the metal up to 12,000 W/m2K with a circulation speed of 18 cm/sec.

The melting process begins with the setting of the temperature of the circulating metal (in the case of melting iron the temperature is raised up to 1580° C.). Then the loading of scrap metal at the rear area next to the heating chamber and the melting of the added scrap starts, producing a decrease in temperature of the circulating metal. The temperature of the metal at the output of the furnace is controlled by a submerged thermocouple placed in the area of extraction of metal and slag. This temperature is set preferably at 1400° C. and can be controlled by regulating the quantity of scrap loaded and/or the heating power applied to the plasma torch in the heating chamber. The melting of the metal loaded raises the level of the bath and produces an overflow of metal and slag through the outlet spout. This metal is poured into a crucible that has an intermediate wall and two lateral spouts at different heights, with the separation of the metal being performed through decantation and by tapping the metal through the lower spout and the slag through the upper spout.

The loaded materials, depending on their density and geometry, can be submerged in the metal bath or float together with the slag, in which case, they are retained by the retaining means located at the opposite end of the canal. This retaining means are located at sufficient distance with respect to the surface of the molten metal bed, in such a way that it allows the slag to pass through, floating on top of the molten metal bed. On the front wall of the furnace (with respect to the direction of circulation of the molten metal) a burner is provided, which allows full fluidization of semi-solid slag to facilitate its passage to the extraction area. In the extraction area, a second burner is provided, which keeps the slag in a liquid state pushing it in the direction in which of the emptying spout. To avoid the slag passing towards the heating chamber, a wall partially submerged in the metal and closing the extraction area is provided. This way the surface of the metal in the heating chamber is free of slag to proceed to a new cycle of overheating and melting of the load.

The absence of slag in the loading area and the continuous stirring of the metal through the action of the magnetic rotor, permits the addition of the alloy-forming elements necessary to achieve an adequate metallurgical quality to the requirements of the final product.

Example 2: Treating Process: Steel Dust

Steel dust collected in aspiration electric arc furnace filters (EAFD) is a residue with high concentrations of metal oxides, mainly iron, zinc and lead. For the recovery of these metals by carbon reduction, it is necessary to agglomerate this dust with a product rich in carbon, mainly those comprising the group of metallurgical coke, anthracite, coal and graphite. Preferred forms of agglomeration of the dust are high density briquette produced by pressing or pellet agglomerated by rotation in a pelletizing drum.

The process of reduction of metal oxides contained in steel dust is carried out by means of the carbon added to the briquette or pellets in such a way that the iron oxide is reduced to metal and becomes part of the molten metal bath. Similarly, other main oxides, Zn and Pb, at first are reduced to metal and, given the volatility of both metals, are dragged towards the gas treatment system where they oxidise easily giving rise to a concentration of oxides, mainly consisting of zinc oxide and lead and, to a lesser extent, of iron oxides, chlorides, silica, alkali, etc. The thick fraction of this concentration of metal oxides is retained in the gas treatment system, which consists of one or more of the following elements: cyclone, bag filter, scrubber.

The main reduction processes, given the concentration of these oxides in the steelmaking dust are:

$$FeO+C \Rightarrow Fe+CO \quad \Delta H=38.6 \text{ kcal/mol}$$

$$Fe_2O_3+3C \Rightarrow 2Fe+3CO \quad \Delta H=117.74 \text{ kcal/mol}$$

$$Fe_3O_4+4C \Rightarrow 3Fe+4CO \quad \Delta H=161.62 \text{ kcal/mol}$$

$$ZnO+C \Rightarrow Zn+CO \quad \Delta H=57.34 \text{ kcal/mol}$$

$$PbO+C \Rightarrow Pb+CO \quad \Delta H=25.70 \text{ kcal/mol}$$

$$CO_2+C \Rightarrow 2CO \quad \Delta H=41.21 \text{ kcal/mol}$$

In addition to these primary reactions, other reactions of reduction with CO and side reactions take place that are set out in the following table:

TABLE 1

Possible reactions and reaction enthalpies in a furnace loaded with steel dust briquettes.

| Reaction | Reaction Enthalpy (kcal/mol) |
|---|---|
| $MnO + C = Mn + CO$ (g) | 65.65 |
| $3Fe_2O_3 + 9CO$ (g) $= 6\ Fe + 9CO_2$ (g) | −17.67 |
| $MnO + CO$ (g) $= Mn + CO_2$ (g) | 24.44 |
| $ZnO + CO$ (g) $= Zn + CO_2$ (g) | 16.13 |
| $PbO + CO$ (g) $= Pb + CO_2$ (g) | −15.51 |
| $Zn = Zn$ (g) | 31.17 |
| $Zn$ (g) $+ 1/2O_2$ (g) $= ZnO$ (s) | −114.93 |
| $C + O_2$ (g) $= CO_2$ (g) | −94.05 |
| $2CO = CO_2$ (g) $+ C$ | −41.21 |
| $ZnOFe_2O_3 = ZnO + Fe_2O_3$ | 1.04 |
| $ZnOFe_2O_3 + CO = Zn + CO_2$ (g) $+ Fe_2O_3$ | 17.17 |
| $3Fe_2O_3 = 6Fe + 9/2O_2$ (g) | 591.00 |
| $PbSO_4 = PbO + SO_2$ (g) $+ 1/2O_2$ (g) | 97.57 |
| $3CaO + P_2O_5 = Ca_3(PO_4)_2$ | −172.93 |
| $H_2O = H_2O$ (v) | 10.52 |
| $NaCl = NaCl$ (v) | 54.90 |
| $KCl = KCl$ (v) | 53.06 |

The sequence of the carbothermic reduction procedure of the process can be as follows:

a) Reduction of the zinc oxide by C and CO:

$$ZnO(s)+C \Rightarrow Zn(s)+CO(g)$$

$$ZnO(s)+CO \Rightarrow Zn(s)+CO_2(g)$$

b) A part of the zinc evaporates and the other condenses on the surface of the briquettes, according to the equations:

$$Zn(s) \Rightarrow Zn(g)$$

$$Zn(g) \Rightarrow Zn(s)$$

c) Rapid oxidation of zinc gas according to the equation:

$$Zn(g)+\tfrac{1}{2}O_2(g) \Rightarrow ZnO(s)$$

d) Zinc oxidation condensed on the surface of the briquette with the iron oxides of the briquette, according to:

$$Zn(s)+FeO \Rightarrow ZnO(s)+Fe(s)$$

e) Reduction of iron oxides ($FeO$,$Fe_2O_3$, $Fe_3O_4$) with carbon and CO, according to:

$$FeO+C \Rightarrow Fe(s)+CO(g)$$

$$Fe_2O_3+3C \Rightarrow 2Fe(s)+3CO(g)$$

$$Fe_2O_3+CO \Rightarrow 2Fe(s)+3CO_2(g)$$

f) These latest reactions are influenced by competition between the oxidation reactions of coal and the Boudouard reaction:

$$C+\tfrac{1}{2}O_2(g) \Rightarrow CO(g)$$

$$C+CO_2(g) \Rightarrow 2CO(g)$$

The process is carried out starting from a molten metal bath, at a temperature between 1,400 and 1,500° C. Auto reduction briquettes or pellets are added to the molten metal bath in order to facilitate the incorporation of reduced iron to the molten metal bath. A bottom bath saturated in carbon is used that does not disturb the effect of the portion of this element which reduces the different iron oxides in the briquettes or pellets for their later addition to the molten metal, thus allowing the evaluation of changes that are produced in the resulting metal depending on the different origins of the processed dust.

The briquettes or pellets are placed in the loading area which is free of slag, where they float on the overheated molten metal coming from the heating chamber. This molten metal gives some of its energy to the load (briquettes or pellets) and the process of reduction of dust starts while being dragged by the molten metal along the treatment area. During this movement, the metallic fraction of the dust is incorporated into the molten metal bath, the volatile fraction is aspirated and collected in the filters and the inert fraction floats on the molten metal in the form of liquid slag. On arrival at the retaining means ((located at the end of the treatment area and at a maximum height of 2 mm with respect to the bath) all those particles larger than the height of the passage formed are retained until their dissolution. The floating slag continues its circulation under the retaining means until it reaches the siphoning wall (which is sunk up to a maximum of 40 mm in the bath) where, due to the circulation of molten metal, is directed to the outlet spout together with the metal, leaving the tank of the furnace together with the metal by overflow of the bath. On its exit, the mixture of slag and metal is once again siphoned in a crucible with an intermediate wall, and the slag is separated from the metal.

The process is done automatically, by adjusting the quantity of material loaded and the heating capacity based upon the temperature of the metal and slag at the exit of the furnace, measured by the thermocouple installed in the extraction area.

In sum, a furnace of discretionary use has been provided, in which the chemical composition can be modified at will thanks to the available access to the clean metal, which permits continuous removal of slag and which can be loaded with any dry metallic waste, while providing an optimized energetic performance.

On the other hand, the disclosure is obviously not limited to the specific embodiment(s) described herein, but also encompasses any variations that may be considered by any person skilled in the art (for example, as regards the choice of materials, dimensions, components, configuration, etc.).

The invention claimed is:

1. A furnace comprising:

a tank having an outer wall and an inner wall, arranged to define a closed canal between said inner wall and said outer wall, a central hollow delimited by said inner wall, and at least one driving means located within said central hollow, wherein said at least one driving means comprises a rotor comprising at least two permanent magnets, the rotor being coupled to a motor and configured to rotate upon activation of said motor, thus generating a magnetic field, the furnace being wherein the tank is configured to, in use of the furnace, be filled with molten metal which will circulate along said closed canal in a continuous and cyclical manner, said furnace comprising in said closed canal between said inner wall and said outer wall:

at least one heating area comprising heating means configured to transfer energy to the molten metal thus overheating said molten metal;

at least one loading area configured for loading metal or metallic waste into said molten metal to be melted or treated, said metal or metallic waste, in used of the furnace, being dragged by the overheated molten metal on its surface;

a melting/treatment area configured to receive the overheated molten metal and the metal or metallic waste dragged on its surface, the overheated molten metal transferring its exceeding energy to the dragged metal or metallic waste thus causing its melting/treatment;

said magnetic field generated by said rotor being capable of causing said circulation of the molten metal within said closed canal in a continuous and cyclical manner along the heating area, loading area and melting/treatment area.

2. The furnace of claim 1, wherein said at least one loading area overlaps partially or totally with said at least one heating area.

3. The furnace of claim 1, wherein said melting/treatment area overlaps at least partially with said at least one heating area.

4. The furnace of claim 1, wherein said rotor is surrounded by a first thermal isolating body permeable to the magnetic field disposed between the rotor and an outer face of the inner wall of the tank which delimits the central hollow, said first thermal isolating body defining a first channel between the rotor and an inner wall of the thermal isolating body and a second channel between an outer wall of the first thermal isolating body and the outer face of the inner wall which delimits said central hollow, at least one of said first and second channels being configured to receive an air flow from blowing means configured to provide refrigerating air to the rotor in order to prevent the rotor from heating over a certain temperature.

5. The furnace of claim 4, wherein said thermal isolating body is made of a material chosen from the following materials: stainless steel, mica, a composite material or a combination thereof.

6. The furnace of claim 1, wherein the outer face of the inner wall of the tank, which delimits said cavity, is covered with a second thermal isolating body.

7. The furnace of claim 1, wherein the outer face of the inner wall of the tank, which delimits said cavity, is made of a second thermal isolating body.

8. The furnace of claim 1, wherein at said at least one heating area the heating means is placed substantially outside the effect of the magnetic field generated by the driving means.

9. The furnace of claim 8, wherein at said at least one heating area the outer wall of the tank defines a protrusion, said heating means being placed in said protrusion.

10. The furnace of either claim 8, wherein at said at least one heating area the inner wall of the tank defines a protrusion, said heating means being placed in said protrusion.

11. The furnace of claim 1, further comprising an extraction area ending in a siphoning wall configured for preventing the progress of the slag, said extraction area comprising extraction means for pouring part of the molten metal and/or slag.

12. The furnace of claim 1, wherein said at least one melting/treatment area comprises retaining means whose lower part ends slightly above the level reached by the melted metal within the tank, the retaining means being configured for, when the circulating molten metal and the dragged metal or metallic waste on its surface reach the retaining means, preventing the metal or metallic waste on the melted surface from travelling forward, so that the waste is substantially smelted on the surface of the molten metal bed, without preventing the progress of the molten metal beneath the retaining means.

13. The furnace of claim 1, wherein said heating means is a plasma torch.

14. The furnace of claim 1, wherein the angular velocity of the circulating molten metal is constant at the melting/treatment area.

15. Use of the furnace of claim 1 for melting or treating ferrous or non-ferrous materials.

16. A method for treating or melting metal or metallic waste in a furnace comprising a tank having an outer wall and an inner wall, said furnace defining a closed canal between said inner wall and said outer wall of the tank, the method comprises the steps of:

filling said tank with molten metal, at at least one heating area, transferring energy to the molten metal thus overheating said molten metal;

at at least one loading area, loading metal or metallic waste to be melted or treated, said metal or metallic waste being dragged by the overheated molten metal on its surface;

at at least one melting/treatment area, receiving the overheated molten metal and the metal or metallic waste dragged on its surface, the overheated molten metal transferring its exceeding energy to the dragged metal or metallic waste;

wherein said molten metal circulates along said closed canal in a continuous and cyclical manner, said movement being achieved by the action of at least one driving means located within a central hollow delimited by said inner wall of the tank, said at least one driving means comprising a rotor comprising at least two permanent magnets, the rotor being coupled to a motor and configured to rotate upon activation of said motor, thus generating a magnetic field capable of causing said circulation of the molten metal in a continuous and cyclical manner along the heating area, loading area and melting/treatment area.

* * * * *